US011300072B1

(12) United States Patent
Fluharty et al.

(10) Patent No.: US 11,300,072 B1
(45) Date of Patent: Apr. 12, 2022

(54) CYLINDER HEAD FOR AN INTERNAL COMBUSTION ENGINE

(71) Applicant: FORD GLOBAL TECHNOLOGIES, LLC, Dearborn, MI (US)

(72) Inventors: Jeffrey D. Fluharty, Woodhaven, MI (US); Paul Thomas Reinhart, Livonia, MI (US); Chad Michael Strimpel, Maybee, MI (US); Dong-Hyun Lee, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/318,447

(22) Filed: May 12, 2021

(51) Int. Cl.
*F02F 1/14* (2006.01)
*F02F 1/40* (2006.01)

(52) U.S. Cl.
CPC ..... *F02F 1/40* (2013.01)

(58) Field of Classification Search
CPC ..... F01M 1/06; F01M 5/00; F01P 3/02; F02F 1/24; F02F 1/38; F02F 1/40
USPC ..... 123/41.79
See application file for complete search history.

(56) References Cited

U.S. PATENT DOCUMENTS 3,491,731 A * 1/1970 Deutschmann ..... F02F 1/4214 123/41.82 R
4,592,329 A * 6/1986 Yunick ..... F02M 31/18 123/545
4,660,527 A * 4/1987 Tanaka ..... F01L 1/0532 123/193.5
4,962,733 A * 10/1990 Cheung ..... F02F 1/38 123/193.5
5,799,627 A * 9/1998 Dohn ..... F02F 1/40 123/41.82 R
5,890,461 A * 4/1999 Iikura ..... F01P 3/14 123/41.82 R
6,681,727 B2 * 1/2004 Krenn ..... F02F 1/40 123/193.5
6,729,272 B2 * 5/2004 Iizuka ..... F01P 7/16 123/41.79

(Continued)

FOREIGN PATENT DOCUMENTS

JP 2020033973 A * 3/2020 ..... F01M 1/06

OTHER PUBLICATIONS

Hojjat Ashouri, Analysis of fatigue cracks of cylinder heads in diesel engines, 2016, p. 378, 1st paragraph (Year: 2016).*

*Primary Examiner* — Hung Q Nguyen
*Assistant Examiner* — Anthony Donald Taylor, Jr.
(74) *Attorney, Agent, or Firm* — Geoffrey Brumbaugh; Brooks Kushman P.C.

(57) ABSTRACT

A cylinder head for an internal combustion engine includes a first wall, a second wall, and a post. The first wall defines an exhaust channel that is configured to direct exhaust gas away from the engine. The second wall forms an exterior of the cylinder head and defines a water jacket between the first wall and the second wall. The water jacket is configured to channel coolant through the cylinder head. The post is disposed within the water jacket. The post extends between and is secured to each of the first and second walls. The post tapers from the first wall to a center portion of the post. The post also tapers from the from the second wall to the center portion of the post. The post is configured to fracture in response to a thermal load generated by the engine.

11 Claims, 4 Drawing Sheets

(56) References Cited

U.S. PATENT DOCUMENTS

| | | | | |
|---|---|---|---|---|
| 6,827,049 | B2 * | 12/2004 | Oh | F02F 1/40 123/41.82 R |
| 7,007,637 | B2 * | 3/2006 | Hwang | F02F 1/10 123/41.72 |
| 7,044,089 | B2 * | 5/2006 | Yamada | F02F 1/38 123/41.72 |
| 7,240,644 | B1 * | 7/2007 | Slike | F02F 1/40 123/41.72 |
| 8,857,387 | B2 * | 10/2014 | Schlidt | F02F 1/40 123/41.82 R |
| 8,904,773 | B2 * | 12/2014 | Maruyama | F02F 1/40 60/321 |
| 9,188,051 | B1 * | 11/2015 | Zahdeh | F01N 13/1866 |
| 9,470,178 | B2 * | 10/2016 | Beyer | F01P 3/02 |
| 2005/0252463 | A1 * | 11/2005 | Matsui | F02F 1/40 123/41.82 R |
| 2007/0227473 | A1 * | 10/2007 | Tsubouchi | F02F 1/243 123/41.31 |
| 2008/0314339 | A1 * | 12/2008 | Koseki | F02F 1/4264 123/41.52 |
| 2012/0227686 | A1 * | 9/2012 | D'Anna | F02F 1/243 123/41.82 R |
| 2012/0312257 | A1 * | 12/2012 | Beyer | F02F 1/243 123/41.82 R |
| 2013/0055971 | A1 * | 3/2013 | Brewer | F02F 1/36 123/41.82 R |
| 2016/0061149 | A1 | 3/2016 | Moran et al. | |
| 2017/0152787 | A1 * | 6/2017 | Kubo | F02F 1/36 |
| 2017/0159541 | A1 * | 6/2017 | Kubo | F01P 3/02 |
| 2020/0271043 | A1 * | 8/2020 | Murray | F01P 5/10 |

* cited by examiner

CYLINDER HEAD FOR AN INTERNAL COMBUSTION ENGINE

TECHNICAL FIELD

The present disclosure relates to an internal combustion engine and more specifically to a cylinder head for an internal combustion engine.

BACKGROUND

Internal combustion engines include cylinder heads that house intake and exhaust valves. The intake valves are configured to open to direct an air-fuel mixture into the combustion chambers of the engine. The exhaust valves are configured to open to direct exhaust gas out the combustion chambers of the engine.

SUMMARY

A cylinder head for an internal combustion engine includes a first wall, a second wall, and a post. The first wall defines an exhaust channel that is configured to direct exhaust gas away from the engine. The second wall forms an exterior of the cylinder head and defines a water jacket between the first wall and the second wall. The water jacket is configured to channel coolant through the cylinder head. The post is disposed within the water jacket. The post extends between and is secured to each of the first and second walls. The post tapers from the first wall to a center portion of the post. The post also tapers from the from the second wall to the center portion of the post. The post is configured to fracture in response to a thermal load generated by the engine.

A cylinder head for an internal combustion engine includes a first wall, a second wall, and a post. The first wall defines a first conduit configured to channel exhaust gas away from the engine. The second wall has an outer surface that defines an exterior of the cylinder head. The second wall has an inner surface that defines a second conduit. The second conduit extends between the first and second walls. The second conduit is disposed on an opposing side of the first wall relative to the first conduit. The second conduit is configured to channel coolant through the cylinder head. The post is disposed within the second conduit. The post has a first end that is secured to the first wall. The post has a second end that is secured to the second wall. A thickness of the post decreases from the first end to a center of the post. The thickness of the post also decreases from the second end to the center of the post. The post is configured to fracture in response to a thermal load generated by the engine.

A cylinder head for an internal combustion engine includes a first wall, a second wall, and a column. The first wall and the second wall define a conduit therebetween. The first wall defines an exhaust channel on an opposing side of the first wall relative to the conduit. The column is disposed within the conduit. The column has a first end secured to the first wall, a second end secured to the second wall, and a central portion that is between the first and second ends. The central portion has a thickness that is less than a thickness of the first end and less than a thickness of the second end. The central portion is configured to fracture in response to a thermal load generated by the engine.

DETAILED DESCRIPTION

Figure 1:
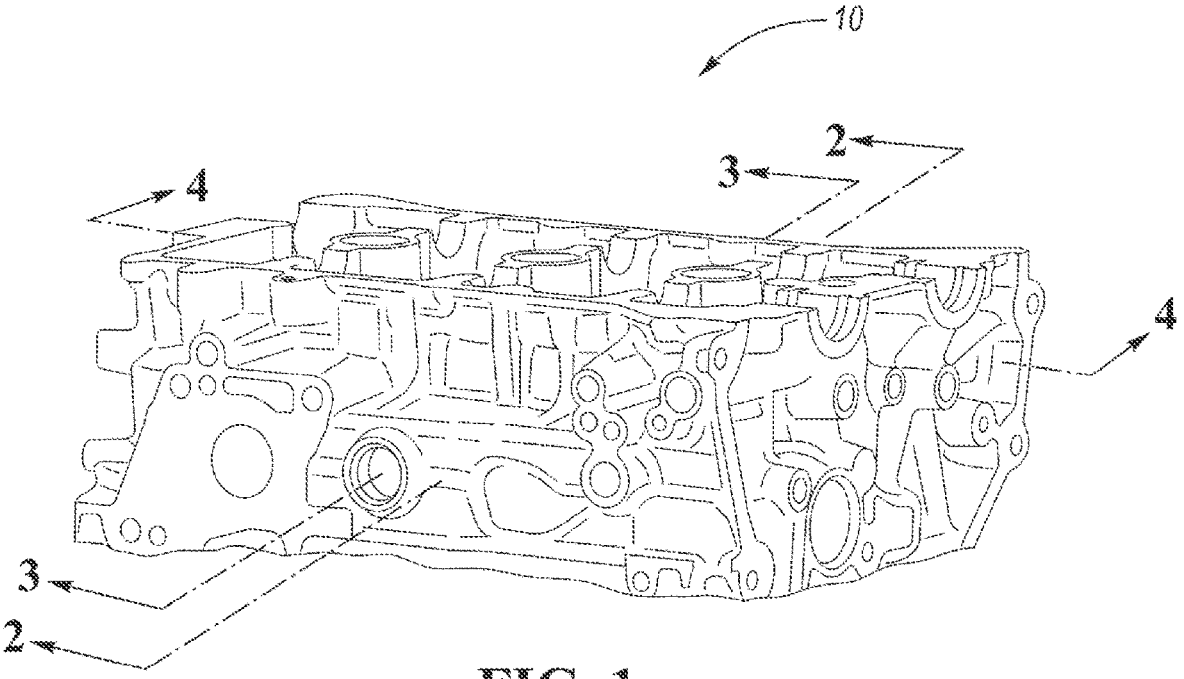
FIG. 1 is an isometric view of a cylinder head of an internal combustion engine.
Figure 2:
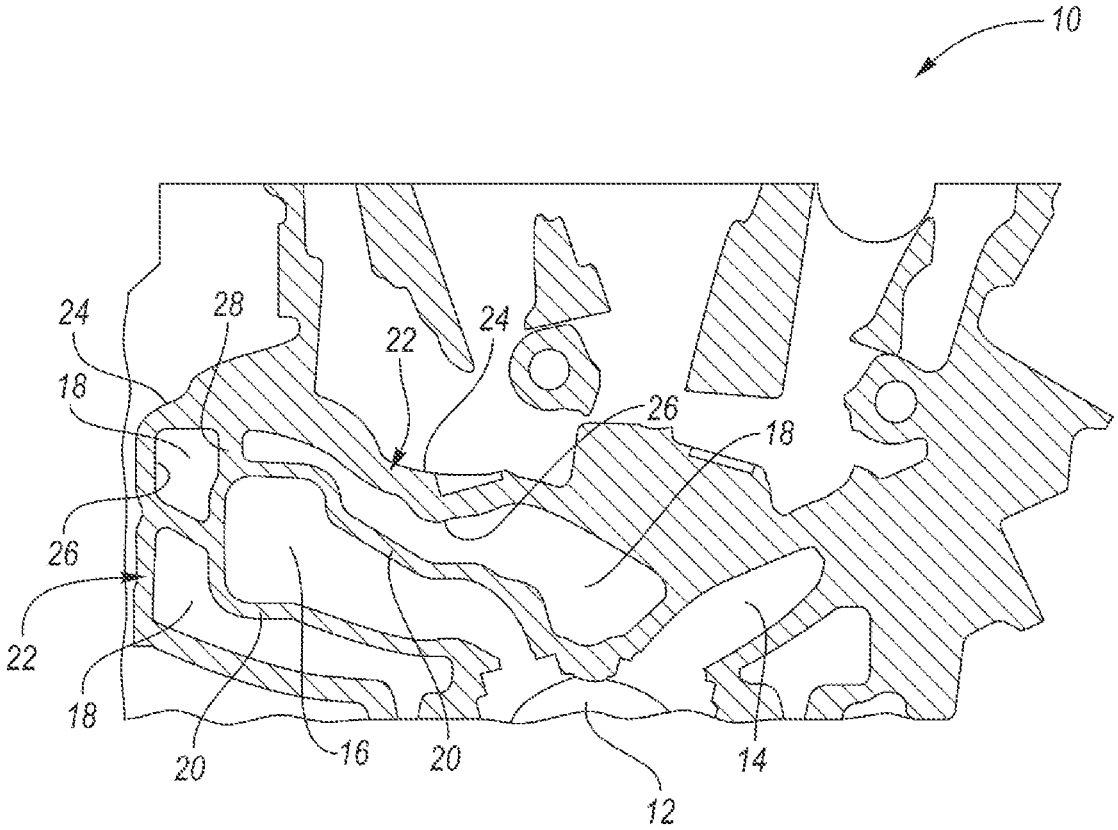
FIG. 2 is a cross-sectional view taken along line 2-2 in FIG. 1.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Referring to FIGS. 1-5, a cylinder head 10 for internal combustion engine is illustrated. The cylinder head 10 may include an integrated exhaust manifold (i.e., the exhaust manifold that receives the exhaust gas from the cylinders of the engine is integral to the cylinder head 10). The cylinder head 10 defines combustion chambers 12 or a portion of the combustion chambers 12 of the engine. Intake ports, conduits, or channels 14 are defined within the cylinder head 10. The intake channels 14 are configured to channel or deliver air to the cylinders defined by an engine block (not shown). The air is mixed with fuel so that the oxygen within the air and the fuel may be combusted via a spark plug (not show). The fuel may be delivered to the cylinders along with the air in the intake channels or may be delivered to the cylinders separately via fuel injectors (not shown). Air intake valves (not shown) may be disposed within intake channels 14 adjacent to the combustion chambers 12. The air intake valves associated with each cylinder may be configured to open during an intake stroke of a piston of the associated cylinder and to close during compression, power, and exhaust strokes of the piston of the associated cylinder.

Exhaust ports, conduits, or channels 16 are defined within the cylinder head 10. The exhaust channels 16 are configured to channel or direct exhaust gas away from the cylinders of the engine. Exhaust valves (not shown) may be disposed within exhaust channels 16 adjacent to the combustion chambers 12. The exhaust valves associated with each cylinder may be configured to open during an exhaust stroke of the piston the associated cylinder and to close during intake, compression, and power strokes of the piston the associated cylinder.

The cylinder head 10 may further define cavities, conduits, channels, or water jackets 18 that are configured to channel or direct a liquid coolant (e.g., a glycol/water mixture) or oil through the cylinder head 10 for the purpose of cooling the cylinder head 10. Some of the water jackets 18 may be disposed proximate to the exhaust channels 16 and the combustion chambers 12 where a significant amount of heat is generated during combustion. The water jackets 18 may be in fluid communication with a pump to generate flow of the liquid coolant, water jackets defined within the engine block, and a heat exchanger (e.g., a radiator) that removes heat from the liquid coolant. It should be noted that the cavities, conduits, or channels illustrated as water jackets 18 may alternatively be utilized to transport oil through the cylinder head 10 as opposed to a liquid coolant. In such an alternative arrangement, the cavities, conduits, or channels illustrated as water jackets 18 may be referred to as oil passages or oil ports.

Figure 3:
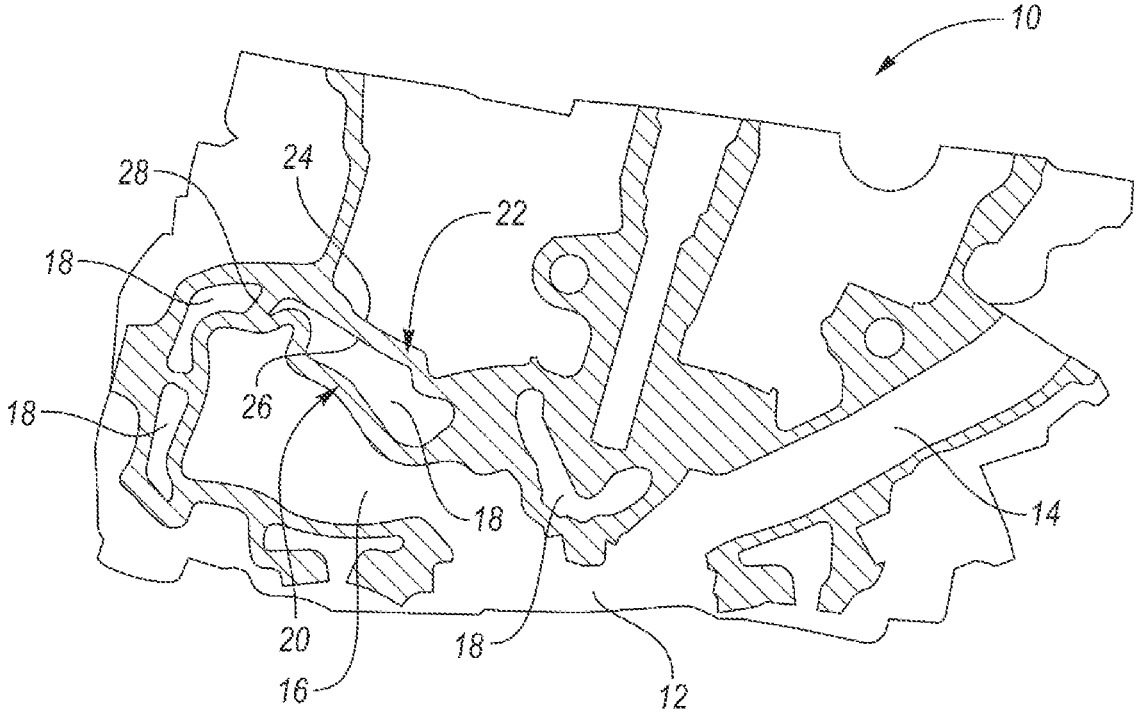
FIG. 3 is a cross-sectional view taken along line 3-3 in FIG. 1 illustrating the cylinder head in a deformed state.
Figure 4:
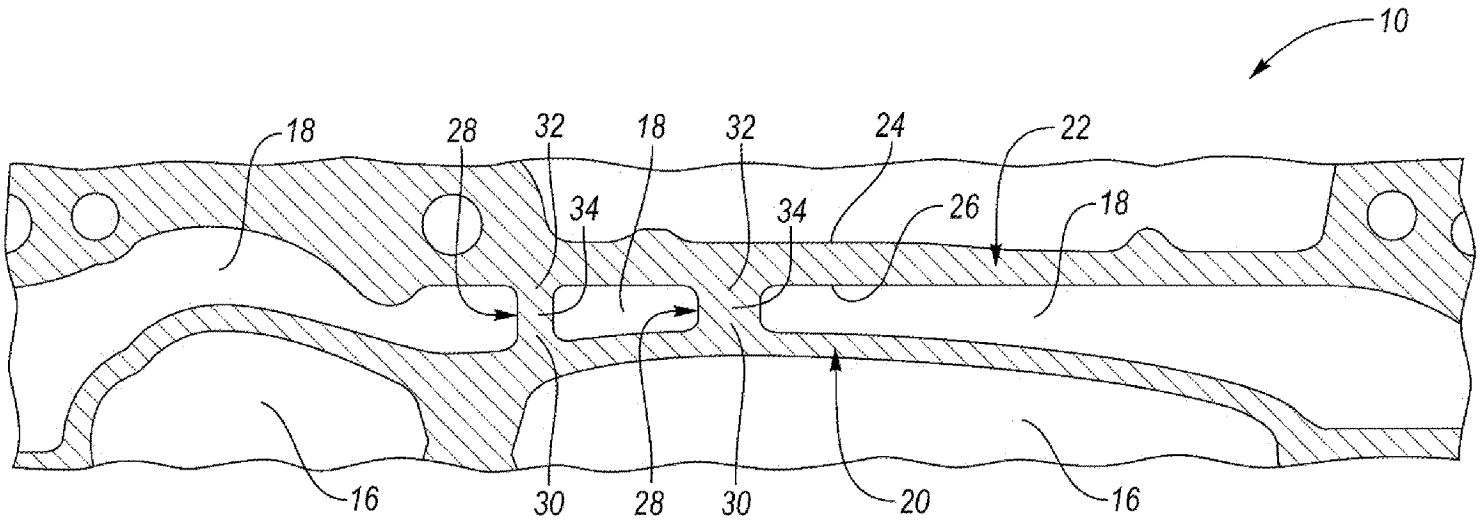
FIG. 4 is a cross-sectional view taken along line 4-4 in FIG. 1.

When incorporating an IEM (integrated exhaust manifold) inside of a cylinder head, one or more posts connecting internal walls that define the gas cores (e.g., exhaust channels 16) to the exterior walls are added to the design in order to avoid air entrapment (i.e., to allow venting) during the casting process of the cylinder head. The added posts are a cheap and easy to add to the tooling of the cylinder head to correct the air entrapment issue. The posts are also required to allow for proper feed of molten aluminum alloy during the initial pouring and solidification of the cylinder head casting. However, the posts create may create an issue during engine operation. More specifically, the posts may restrict the desired thermal expansion of the IEM in the cylinder head during operation of the engine. The exhaust gas creates thermal expansion on the internal walls of the cylinder head that define the exhaust channels while the cooler exterior walls of the cylinder head do not thermally expand or do not thermally expand to the extent that the internal walls expand. This may create stress and strain on the walls of the cylinder head due to thermal deltas between the internal and exterior walls that are connected via the posts. This may result in stress on the cylinder head that exceeds the material properties of the cylinder head resulting in deformation, cracking, or fracturing of the cylinder head along the exterior walls and/or exhaust ports, allowing coolant and/or exhaust gas to pass through the cracks or fractures, which could results in leakage, reduced operating function, and potential thermal events. An example of deformation of the cylinder head 10 due to thermal is illustrated in FIG. 3.

The idea described herein, alleviates the problem described above by including posts that have geometrical shapes that allow for the proper casting process feed and venting to yield a quality casting, while at the same time being designed to fracture upon an initial thermal load so that the posts do not introduce stress and strain of the walls of the cylinder head during thermal loading, which prevents the undesired cracking or fracturing of the cylinder head along the exterior walls and/or exhaust ports. The geometric shapes allow the thermal stresses to load and fracture the posts, separating the two adjacent walls in the cylinder head during an initial thermal loading without comprising the functionality of the cylinder head. Once the posts have been cracked/fractured, the general stresses induced to the cylinder head would be locally eliminated as the two surfaces with high thermal deltas become de-coupled. This approach allows the casting process to have the benefit of the posts without the long-term operating stresses the posts may generate during thermal loading of the cylinder head.

The cylinder head 10 includes a first wall 20 that defines an exhaust channel 16. The first wall 20 may be an internal, inner, or interior wall of the cylinder head 10. The cylinder head 10 includes a second wall 22 that defines a water jacket 18 and forms an exterior of the cylinder head 10. The second wall 22 may be an external, outer, or exterior wall of the cylinder head 10. Alternatively, the second wall 22 may not be an exterior wall and an oil passage or oil port may be disposed on the opposite side of the second wall relative to the water jacket 18. The water jacket 18 may be defined between the first wall 20 and the second wall 22. More specifically, the second wall 22 may have an outer surface 24 that defines the exterior of the cylinder head 10 and an inner surface 26 that defines the water jacket 18. The second wall 22 is disposed on an opposing side of the first wall 20 relative to the exhaust channel 16. The exhaust channel 16 and the water jacket 18 are be disposed on opposing sides of the first wall 20.

Figure 5:
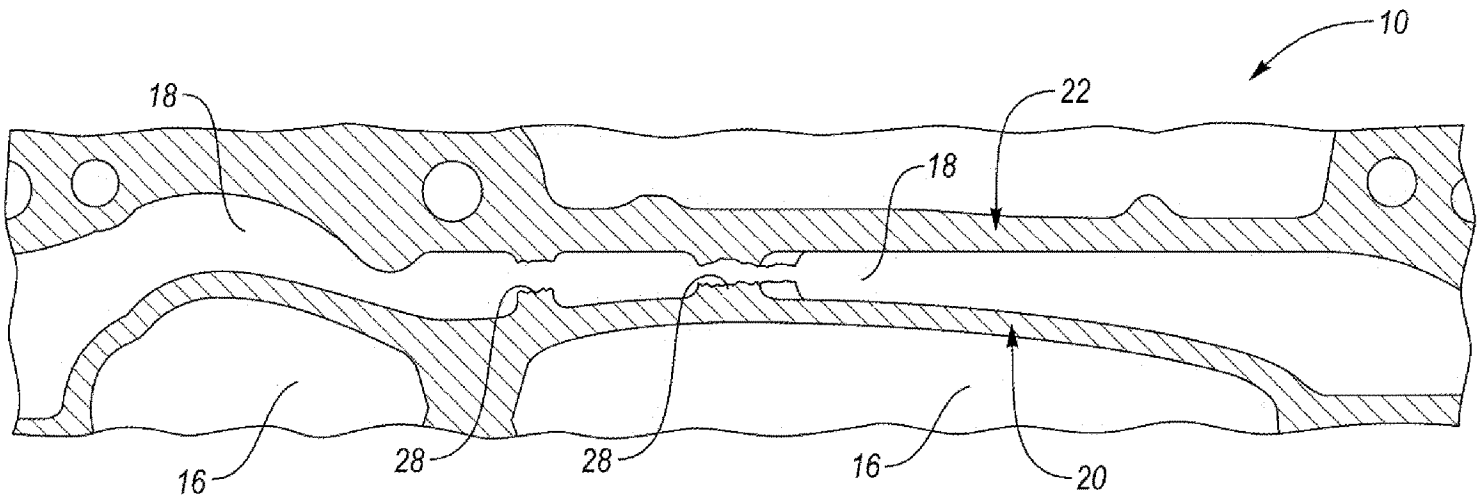
FIG. 5 is an alternative cross-sectional view taken along line 4-4 in FIG. 1 illustrating various structures within the cylinder head in fractured states.

One or more columns or posts 28 are disposed within the water jacket 18. It should be noted that the post 28 on the right side of FIGS. 4 and 5 may be a fluid diverter that has a different shape than the post 28 on the left side of FIGS. 4 and 5. For example, the fluid diverter may be elongated further into the paper in the views in FIGS. 4 and 5 relative to the post 28 on the left side of FIGS. 4 and 5. The posts 28 extend between and secured to each of the first wall 20 and the second wall 22. First ends 30 of the posts 28 are secured to the first wall 20 and second ends 32 of the posts 28 are secured to the second wall 22. The posts 28 are configured to fracture in response to a thermal load generated by the engine. An example of the posts 28 in a fractured condition after the introduction of a thermal load is illustrated in FIG. 5.

The thicknesses, T, of the posts 28 may decrease from the first ends 30 to center or central portions 34 of the posts 28 and may decrease from the second ends 32 to the central portions 34. Stated in other terms, the posts 28 may taper from the first ends 30 to the central portions 34 and may taper from the second ends 32 to the central portions 34 such that central portions 34 have a thickness, T, that is less than thicknesses, T, of both the first ends 30 and the second ends 32. The central portions 34 of the posts 28 may more specifically be the portions of the posts 28 that are configured to fracture in response to a thermal load generated by the engine due to the decrease in thickness, T, which results in a localized decrease in strength of the post along the central portions 34.

Figure 6:
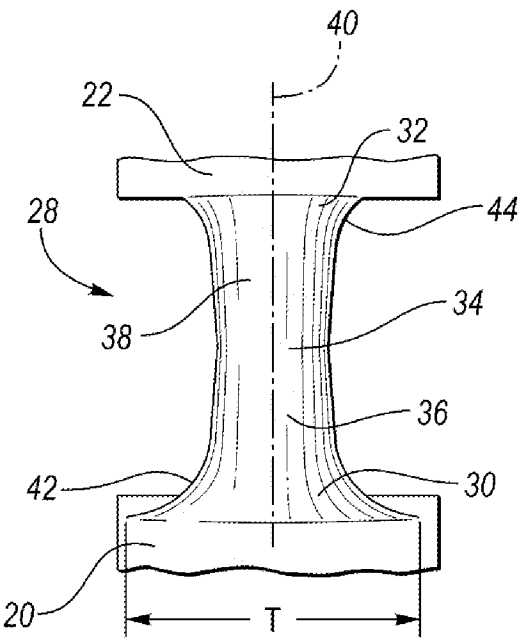
FIG. 6 is a first embodiment of a post or column structure that is formed within the cylinder head.

Referring to FIG. 6, a first embodiment of the post 28 is illustrated. The post 28 is comprised of a first frustoconical portion 36 that tapers from the first wall 20 to the central portion 34 of the post 28 and a second frustoconical portion 38 that tapers from the second wall 22 to the central portion 34 of the post 28, such that the central portion 34 of the post 28 has a thickness, T, that is less than thicknesses, T, of both the first end 30 and the second end 32 of the post 28. The first frustoconical portion 36 may be concentrically aligned with the second frustoconical portion 38. More specifically, the first frustoconical portion 36 may be concentrically aligned with the second frustoconical portion 38 along axis 40. The first frustoconical portion 36 may include a first fillet 42 that extends to the first wall 20. The second frustoconical portion 38 may include a second fillet 44 that extends to the second wall 22. The outer surface of the post 28 along the first frustoconical portion 36 and the outer surface of the post 28 along the second frustoconical portion 38 may each have a draft angle (i.e., an angle of orientation from axis 40) that ranges between 2.5° and 15°.

Figure 7:
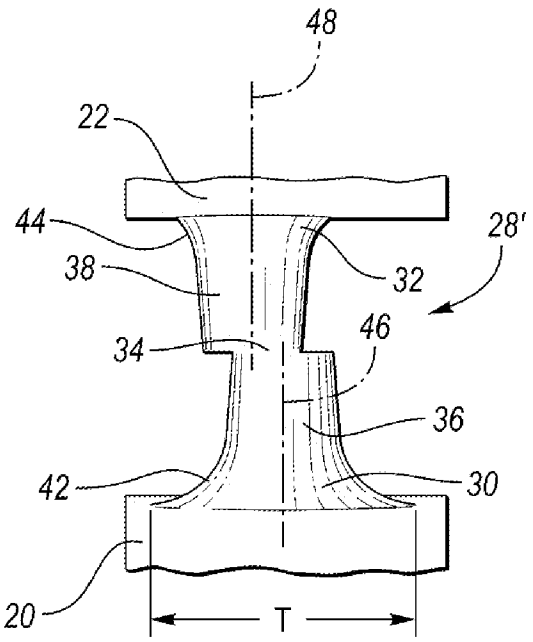
FIG. 7 is a second embodiment of the post or column structure that is formed within the cylinder head.

Referring to FIG. 7, a second embodiment of the post 28' is illustrated. The post 28' is comprised of the first frustoconical portion 36 that tapers from the first wall 20 to the central portion 34 of the post 28' and the second frustoconical portion 38 that tapers from the second wall 22 to the central portion 34 of the post 28' such that the central portion 34 of the post 28' has a thickness, T, that is less than thicknesses, T, of both the first end 30 and the second end 32 of the post 28'. The first frustoconical portion 36 in the second embodiment of the post 28', however, may be concentrically offset from the second frustoconical portion 38. More specifically, the first frustoconical portion 36 may extend longitudinally along axis 46 and the second frustoconical portion 38 may extend longitudinally along axis 48, where axis 46 and axis 48 are offset relative to each other. The first frustoconical portion 36 may include the first fillet 42 that extends to the first wall 20. The second frustoconical portion 38 may include the second fillet 44 that extends to the second wall 22. The outer surface of the post 28' along the first frustoconical portion 36 and the outer surface of the post 28' along second frustoconical portion 38 may each have a draft angle (i.e., an angle of orientation from axis 46 and axis 48, respectively) that ranges between 2.5° and 15°. It should be noted that post 28' should be construed to have all the characteristics of post 28 unless otherwise stated herein.

Figure 8:
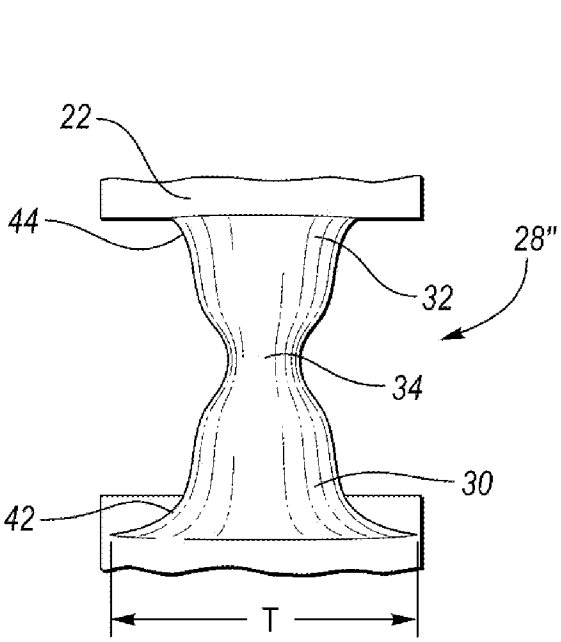
FIG. 8 is a third embodiment of the post or column structure that is formed within the cylinder head.

Referring to FIG. 8, a third embodiment of the post 28" is illustrated. The third embodiment of the post 28" may have an hour-glass shape such that the central portion 34 of the post 28" has a thickness, T, that is less than thicknesses, T, of both the first end 30 and the second end 32 of the post 28". The first end 30 of the post 28" may include the first fillet 42 that extends to the first wall 20. The second end 32 of the post 28" may include the second fillet 44 that extends to the second wall 22. The outer surface of the post 28" may includes a series of curves that form the hour-glass shape. It should be noted that post 28" should be construed to have all the characteristics of post 28 unless otherwise stated herein.

It should be noted that the cylinder head 10 may include multiple posts 28 that are positioned at various positions. For example, a pattern of posts 28 may be repeated proximate to each combustion chamber 12. It should also be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A cylinder head for an internal combustion engine, the cylinder head comprising:

a first wall defining an exhaust channel that is configured to direct exhaust gas away from the engine;

a second wall forming an exterior of the cylinder head and defining a water jacket between the first wall and the second wall, wherein the water jacket is configured to guide coolant through the cylinder head; and a post disposed within the water jacket, the post extending between and secured to each of the first and second walls, wherein the post (i) tapers from the first wall to a center portion of the post, (ii) tapers from the second wall to the center portion of the post, and (iii) is configured to fracture in response to a thermal load generated by the engine, wherein the post is comprised of a first frustoconical portion that tapers from the first wall to the center portion of the post and a second frustoconical portion that tapers from the second wall to the center portion of the post, and wherein the first frustoconical portion is concentrically offset from the second frustoconical portion.

2. The cylinder head of claim 1, wherein the first frustoconical portion includes a first fillet that extends to the first wall and the second frustoconical portion includes a second fillet that extends to the second wall.

3. The cylinder head of claim 1, wherein a geometric shape of the post allows thermal stresses to load and fracture the post.

4. The cylinder head of claim 3, wherein the geometric shape of the post includes first and second fillets that extend to the first and second walls, respectively.

5. A cylinder head for an internal combustion engine, the cylinder head comprising:

a first wall defining a first conduit configured to channel exhaust gas away from the engine;

a second wall having an outer surface that defines an exterior of the cylinder head and an inner surface that defines a second conduit, wherein the second conduit extends between the first and second walls, is disposed on an opposing side of the first wall relative to the first conduit, and is configured to guide coolant through the cylinder head; and a post disposed within the second conduit, the post having a first end that is secured to the first wall and a second end that is secured to the second wall, wherein (i) a thickness of the post decreases from the first end to a center of the post, (ii) the thickness of the post decreases from the second end to the center of the post, and (iii) the post is configured to fracture in response to a thermal load generated by the engine, wherein the post is comprised of a first frustoconical portion that tapers from the first wall to the center of the post and a second frustoconical portion that tapers from the second wall to the center of the post, and wherein the first frustoconical portion is concentrically offset from the second frustoconical portion.

6. The cylinder head of claim 5, wherein the first frustoconical portion includes a first fillet that extends to the first wall and the second frustoconical portion includes a second fillet that extends to the second wall.

7. The cylinder head of claim 5, wherein a geometric shape of the post allows thermal stresses to load and fracture the post.

8. The cylinder head of claim 7, wherein the geometric shape of the post includes first and second fillets that extend to the first and second walls, respectively.

9. A cylinder head for an internal combustion engine, the cylinder head comprising:

a first wall and a second wall defining a conduit therebetween, the first wall defining an exhaust channel on an opposing side of the first wall relative to the conduit; and a column disposed within the conduit, the column having (i) a first end secured to the first wall, (ii) a second end secured to the second wall, and (iii) a central portion that is between the first and second ends, wherein the central portion has a thickness that is less than a thickness of the first end and less than a thickness of the second end, wherein the central portion is configured to fracture in response to a thermal load generated by the engine, wherein the column is comprised of a first frustoconical portion that tapers from the first wall to the central portion and a second frustoconical portion that tapers from the second wall to the central portion, and wherein the first frustoconical portion is concentrically offset from the second frustoconical portion.

10. The cylinder head of claim 9, wherein a geometric shape of the column allows thermal stresses to load and fracture the column.

11. The cylinder head of claim 9, wherein the column includes a first fillet along the first end that extends to the first wall, and wherein the column includes a second fillet along the second end that extends to the second wall.

* * * * *